United States Patent [19]

DeVito

[11] 3,937,995

[45] Feb. 10, 1976

[54] HIGH VOLTAGE GROUNDING STRAP

[75] Inventor: Albert P. DeVito, Glenview, Ill.

[73] Assignee: Palmer Industries Ltd., Chicago, Ill.

[22] Filed: Dec. 5, 1974

[21] Appl. No.: 529,615

[52] U.S. Cl. ..... 313/49; 174/35 C; 174/50.52; 178/7.82; 313/482; 339/144 R; 339/222; 339/256 SP

[51] Int. Cl.[2] ..... H01J 31/00

[58] Field of Search ..... 174/35 R, 35 MS, 35 TS, 174/50.52, 50.53; 339/144 R, 222, 256, 258; 313/364, 477, 479, 234, 318, 482; 178/7.8, 7.82, 7.9

[56] References Cited

UNITED STATES PATENTS

| | | | |
|---|---|---|---|
| 2,913,699 | 11/1959 | Cushenberry | 339/222 X |
| 2,996,026 | 8/1961 | Batcheller | 339/256 SP X |
| 3,139,318 | 6/1964 | Binder et al. | 339/258 S |
| 3,614,519 | 10/1971 | Figlewicz et al. | 178/7.82 X |

*Primary Examiner*—Darrell L. Clay
*Attorney, Agent, or Firm*—Leo J. Aubel; Robert E. Wagner; Gerald T. Shekleton

[57] ABSTRACT

High voltage grounding strap including a terminal member with a plurality of resilient tines for providing electrical contact such as to the external Aquadag coating on a picture tube, a receptacle connector formed in the shape of an elongated flattened cylinder and having a flared open end for allowing easy insertion of a corresponding male connector formed on the terminal member. The grounding strap including a plastic sheath extending up to and covering said receptacle connector to minimize corona and arcing and the receptacle connector includes a locking means on its interior surface.

8 Claims, 9 Drawing Figures

FIG. 1
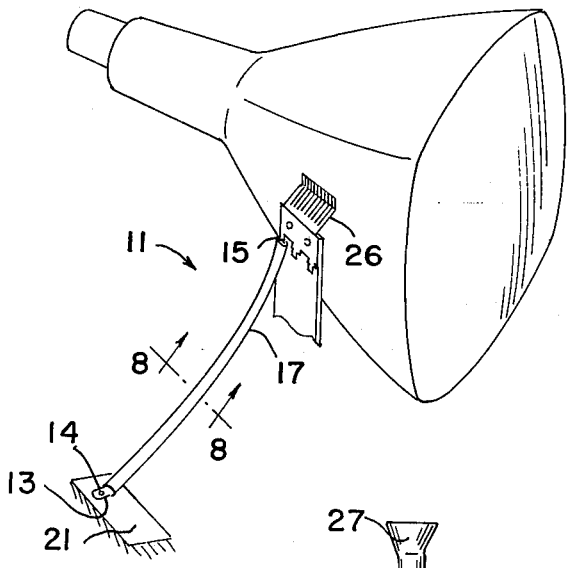
FIG. 2
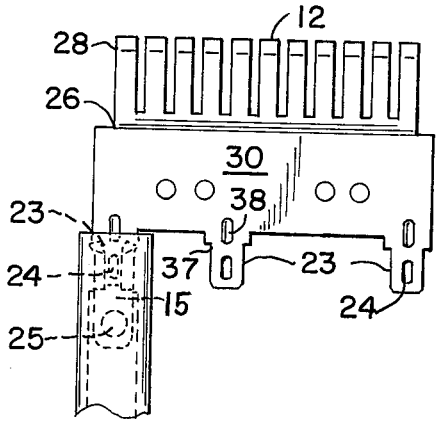
FIG. 4
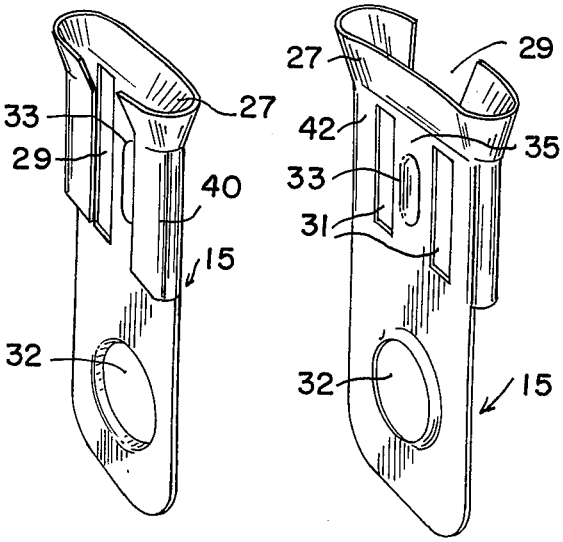
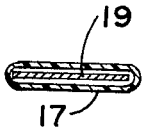
FIG. 8
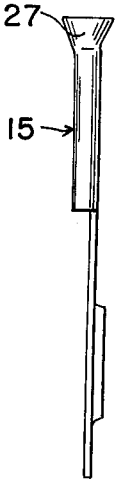
FIG. 5
FIG. 3
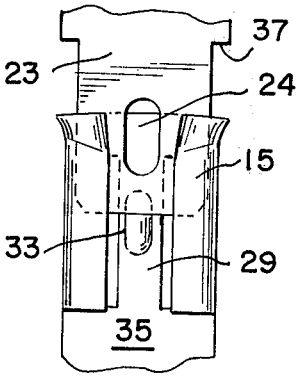
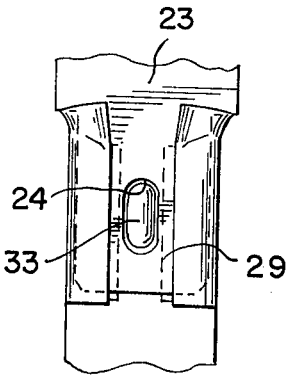
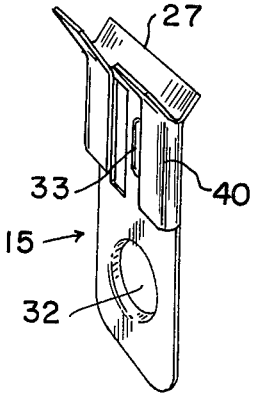
FIG. 6
FIG. 7
FIG. 9

HIGH VOLTAGE GROUNDING STRAP

BACKGROUND OF THE INVENTION

This invention relates to an electrical connector and is particularly directed toward an insulated high voltage grounding strap assembly. High voltage grounding straps have long been used, and the necessary characteristics of a high voltage grounding strap are therefore well known. Such features include suitable mechanical and electrical connections at both discharge and ground terminals, a capacity for operating at the requisite voltages and currents and the capability of withstanding mechanical as well as electrical stresses. Another important feature for grounding straps for use with television picture tubes is that of enabling quick and convenient connecting and disconnecting of the strap end adjacent the picture tube.

A principal feature of the present invention is the provision of an improved grounding strap for television picture tube including an improved assembly for connecting to the picture tube.

SUMMARY OF THE INVENTION

The present invention provides a unique combination of elements which include a connector for electrically connecting, such as to the external conductive coating of a picture tube, the so-called ground dag connector. This connector comprises a device having a plurality of independently resilient tines or comb-like extensions attached to an elongated base. A number of male connector portions extend from the opposite side of the base. This comb has a sufficient number of the resilient tines to insure a good electrical contact with the graphite or aquadag coating on the picture tube, which contact is enhanced by the capability of the free ends of the tines to closely conform to the curvilinear outlines of the tube's outside wall.

Attached to the above-mentioned connector is an electrical lead or ground strap which may be either stainless steel, tincoated copper or tin-coated steel and can be easily stamped out to its desired shape and length. The electrical characteristics of a strap formed of these materials are desirable for its use as a high-voltage grounding strap.

A terminal connector is affixed onto the strap at the end which is adjacent to the picture tube. This connector is essentially a receptacle for a flat electrical tap and is generally in the shape of a flattened oval cylinder, with one of the flattened sides having a centered, longitudinally extending first opening and an outwardly flared upper end portion, the flaring functioning to enable easy insertion of the corresponding male portion.

The side of the flattened oval cylinder generally opposite the first longitudinally extending opening consists of two additional longitudinally extending openings, these openings being spaced and separated by a strip of metal directly opposite the first longitudinally extending opening. This strip of metal has an oval indentation stamped into its center section, which corresponds to a similarly shaped opening in the male portion, so that when the two are connected the famale portion secures the male portion tightly therein, and yet allows an easy release when desired, as will be explained.

From the foregoing description of the receptacle, it can be seen that the nature of its design allows easy insertion and withdrawal of the corresponding male portion while providing a tight fit of said male portion along with a good electrical connection between said male portion and the receptacle.

The plastic sheathing covering the entire connector receptacle portion serves to minimize exposed metallic surface areas and thereby minimizes corona discharges and arcing, thus reducing electrical disturbances or interferences to the picture tube system. A further advantage accruing from this disposition of the plastic sheathing in covering the terminal connections lies in the retardation of corrosion. By completely covering the connection, moisture and corrosion-causing air pollutants are denied contact with the connector, thereby maintaining a clean and electrically sound contact.

It is therefore an object of the present invention to provide an improved high voltage grounding strap.

Another object of the present invention is to provide a reliable electrical connection for the high voltage grounding strap from the picture tube to the ground.

A further object of the present invention is to provide a grounding strap which is suitably sheathed to prevent corona discharge, arcing and corrosion of the conductor.

Still another object of the present invention is to permit easy disengagement of the connected portion.

DESCRIPTION OF THE DRAWINGS

Further objects of the invention together with additional features contributing thereto and advantages accrusing therefrom will be apparent from the following descriptions of one embodiment of the invention when read in conjunction with the accompanying drawings wherein:

FIG. 1 shows a preferred embodiment of the invention connected to a picture tube at one end and to a ground source at the other.

FIG. 2 is a frontal view of the preferred embodiment of the present invention with the plastic sheathing partially cut away to show the connection of the high voltage grounding strap to the picture tube of FIG. 1 in more detail.

FIG. 3 is a front view of the connector portion of the preferred embodiment of the present invention.

FIG. 4 is a back view of the connector portion of the preferred embodiment of the invention.

FIG. 5 is a side view of the connector portion of the preferred embodiment of the present invention.

FIG. 6 is a front view showing the female connector portion of the preferred embodiment of the present invention accepting the male connector portion of the picture tube.

FIG. 7 shows a front view of the female connector portion of the preferred embodiment of the present invention securing holding the male connector protion of the picture tube.

FIG. 8 is a cross-section of the embodiment of the invention taken along the lines 1—1 of FIG. 1.

FIG. 9 is a front view of yet another embodiment of the invention.

DESCRIPTION OF A PREFERRED EMBODIMENT

Referring more specifically to the drawings, FIG. 1 shows a principal use for the present invention, that of providing a ground connection to the external Aquadag or conductive coating of a television set picture tube.

The high voltage grounding strap assembly 11 consists of a metal strip 19 covered by a polymeric, i.e., plastic or vinyl sheathing 17 as can be better seen in FIG. 2. More specifically, the material of choice in the preferred embodiment is a polyvinyl chloride polymer.

The ground connector portion 13 of the present invention consists of a hole 14 integrally stamped or cut into the metal strap 19 whereby the high-voltage grounding strap may be secured to a ground source 21. The ground connector end of the ground strap 11 can thus be conveniently inserted into the plastic sheath 17 to cover the metal strap including the receptacle portion 15, while leaving only the ground connector portion unsheathed to permit mounting of the strap as by a screw onto the chasis or electrical ground reference indicated generally at 21. Insertion of a strap is made extremely convenient by the smooth exterior structure of the ground connector portion 13 which enables the sheath 19 to be easily drawn over the strap 17 in one continuous motion, there being no protuberances or projections on the strap 17 to catch on or engage the sheath. This relationship of the strap to the sheathing can be seen in FIG. 8.

Referring now also to FIG. 2, at the opposite end of the strap, the receptacle or female connector portion 15 of the high voltage grounding strap 11 is connected to the male connector portion 23 and electrically connected to the picture tube by means of a comb shaped contact member 26 which is in contact with the conductive coating of the picture tube. This contact member 26 in the preferred embodiment as shown in FIG. 2 which is substantially in the shape of a comb includes independently resilient tines 28 attached to a base 30. This contact member 26 is formed of a conductive material which is resilient and also resistant to corrosion, such as spring brass. The contact member conforms to the curvilinear shape of the outside wall of the picture tube and maintains sufficient tension in the tine members 28 to insure a good electrical contact at all times and in all positions on the tube. The free end of the tines 12 are angled to provide a relatively flat surface contact against the picture tube.

The male connector portion 23 of the comb 26 is fashioned in such a manner as to provide a stop 37 for the female connector portion 15 to butt up against, thereby giving tactile assurance of a good electrical connection. This male portion 23 has an oval opening 24 corresponding in size, shape and location to the oval indentation or impression of the female connector portion. Along the same axis as this hole 24 of the male connector portion and partially in the body of the comb member is a longitudinal detent 38 forming a strengthening shoulder or ridge, as can be seen clearly in FIG. 2.

Also shown in FIG. 2 are three male portions 23, two of which serve as supplemental to that male portion 23 illustrated in FIG. 1 as being connected to the ground source. These two extra male portions may be used to connect to separate grounding straps similar to strap 19 thereby providing additional electrical grounding reference points.

It can be seen that the vinyl sheathing 17 entirely covers the connection of the male 15 and female 23 portions (which is shown in dotted lines in FIG. 2) thereby providing a shield to prevent corona discharge and arcing as discussed above. The means of attachment of the female connector portion 15 to the high voltage grounding strap can also be seen here wherein a rivet 25 inserted into the aperture 32 (see FIGS. 2, 3 and 4) holds the connector portion 15 securely.

FIGS. 2, 4 and 5 show the detail of the receptacle or female connector portion 15 of the present invention where it can be seen that the flaring 27 around the top of this receptacle serves to allow easy entrance of the male connector portion 23. This flaring can be either entirely around the periphery of the receptacle top as in FIGS. 3 and 4, or only along the front and back sides as in FIG. 9.

As best seen in FIG. 3, the front side of the receptacle 15 comprises a flattened, cylinder 40 with a longitudinally extending opening 29 on its periphery. The rear or back side 42 of the receptacle 15 as best seen in FIG. 4, includes a pair of longitudinal openings 31 defining a metal strip 35 therebetween.

The metal strip 35 has an oval indentation 33 in its mid-section. This indentation 33 serves to retain and hold securely the male portion when inserted. The means of retention between the male portion 23 and the indentation 33 of the female connector portion 15 can be seen more explicitly in FIGS. 6 and 7 wherein the indentation 33 fits into the corresponding opening 24 of the male connector portion 23, the opening 24 being slightly larger than the indentation 33, so that said male connector portion is retained securely when inserted. FIG. 6 shows the male portion 23 being inserted into the receptacle 15, and shows the lower edge of the male portion 23 pushing or bearing against the indentation 33 and thus against the resilient strip 35. Further movement of the male portion 23 into the receptacle 15 as shown in FIG. 7 produces the snap action whereby the resilient strip returns to its original position by virtue of the indentation 33 fitting into the opening 24 of the male portion 23.

In spite of the tight hold afforded by the indentation 33 and the opening 24, an easy withdrawal of the male portion 23 is allowed by the front opening 29 and back opening 31 which is structured in such a manner as to give the conductor portion resiliency and to permit flexing of the connector portion thereby facilitating an easy withdrawal of the female connector portion 15 from the picture tube.

While the invention has been described with reference to a preferred embodiment it will be understood by those skilled in the art that various changes may be made and equivalence may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention but that the invention will include all embodiments falling within the scope of the appended claims.

What is claimed is:

1. A high voltage grounding strap connected to the graphite coating of a cathode ray tube, said grounding strap comprising a connector device having a base with opposing sides, a plurality of independently extending resilient members attached to a first edge of said base, at least one male connector being attached to the edge opposite the first edge of said base, said connector device being electrically connected to the graphite-coated periphery of the cathode ray tube with said resilient members closely conforming to and making electrical contact with the graphite-coated periphery of the cathode ray tube, an electrically conductive strap, a connector means affixed to one end of said strap, said connector means formed as flattened oval having a flared top receiving said male connector therein, metal strips depending from said top, said metal strips having lengthwise openings therebetween, one of said metal strips having an impression thereon facing the interior of the connector means and bearing against and securing said male connector inserted therein, said openings enabling said strips to resiliently deform for facilitating release of said male connector, and insulation sheathing covering the entire electrically conductive strap thereby inhibiting corona discharge and arcing therefrom.

2. The assembly of claim 1 wherein the insulation sheathing is formed of a polymeric material.

3. The assembly of claim 2 wherein the polymeric material is a polyvinyl chloride material.

4. The assembly of claim 1 wherein the strap is formed of a stainless steel metal strip.

5. The assembly of claim 1 wherein the strap is formed of a tin-coated copper.

6. The assembly of claim 1 wherein the strap is formed of a tin-coated steel.

7. The assembly of claim 1 wherein said male connector has an opening therein receiving said impression on said female connecting means thereby grasping and holding said male connector.

8. The assembly of claim 1 wherein three of said male connectors are attached to said opposite edge of said base.

* * * * *